US010720295B2

(12) United States Patent
Pileggi et al.

(10) Patent No.: US 10,720,295 B2
(45) Date of Patent: Jul. 21, 2020

(54) ELECTRONIC ROTARY SWITCH

(71) Applicant: Tektronix, Inc., Beaverton, OR (US)

(72) Inventors: James D. Pileggi, Beaverton, OR (US); Daniel G. Knierim, Beaverton, OR (US)

(73) Assignee: Tektronix, Inc., Beaverton, OR (US)

( * ) Notice: Subject to any disclaimer, the term of this patent is extended or adjusted under 35 U.S.C. 154(b) by 182 days.

(21) Appl. No.: 16/042,146

(22) Filed: Jul. 23, 2018

(65) Prior Publication Data

US 2020/0027676 A1 Jan. 23, 2020

(51) Int. Cl.

| | |
|---|---|
| ***H01H 67/06*** | (2006.01) |
| ***H01H 65/00*** | (2006.01) |
| ***H01H 63/06*** | (2006.01) |
| ***H01H 63/34*** | (2006.01) |
| ***H01H 50/02*** | (2006.01) |
| *H01H 50/44* | (2006.01) |

(52) U.S. Cl.

CPC ..... *H01H 67/06* (2013.01); *H01H 50/023* (2013.01); *H01H 63/06* (2013.01); *H01H 63/34* (2013.01); *H01H 65/00* (2013.01); *H01H 50/44* (2013.01); *H01H 2201/024* (2013.01); *H01H 2203/008* (2013.01); *H01H 2205/004* (2013.01); *H01H 2209/044* (2013.01); *H01H 2225/014* (2013.01)

(58) Field of Classification Search

CPC ..... H01H 67/06; H01H 50/023; H01H 63/06; H01H 63/34; H01H 65/00; H01H 50/44; H01H 2201/024; H01H 2203/008; H01H 2205/004; H01H 2209/044; H01H 2225/014

See application file for complete search history.

(56) References Cited

U.S. PATENT DOCUMENTS 4,458,226 A * 7/1984 Cho ..... G05G 9/04785 273/148 B
5,691,683 A * 11/1997 Allwine, Jr. ..... G01B 7/30 335/302

(Continued)

*Primary Examiner* — Mohamad A Musleh
(74) *Attorney, Agent, or Firm* — Miller Nash Graham & Dunn; Andrew J. Harrington

(57) ABSTRACT

An electronic switch includes a substrate and a rotator assembly. The rotator assembly is configured to prevent rotation between a first rotational configuration and a second rotational configuration in a first translational position of the rotator assembly, while the rotator assembly is configured to rotate between the first rotational configuration and the second rotational configuration in a second translational position of the rotator assembly. The second translational position of the rotator assembly is translationally offset from the first translational position of the rotator assembly. An electrical contact of the rotator assembly is configured to electrically connect an electronic input path of the substrate to an electronic output path of the substrate in the first rotational configuration and first translational position of the rotator assembly, but not to electrically connect the electronic input path to the electronic output path in the second rotational configuration of the rotator assembly or in the second translational position of the rotator assembly.

25 Claims, 9 Drawing Sheets

(56) References Cited

U.S. PATENT DOCUMENTS 5,841,428 A * 11/1998 Jaeger ..... G02F 1/13306
345/184
6,064,197 A * 5/2000 Lochmann ..... G01B 7/30
324/207.14
7,920,037 B2 * 4/2011 Lindsey ..... H01H 1/2058
200/570

* cited by examiner

ELECTRONIC ROTARY SWITCH

FIELD OF THE INVENTION

This disclosure is directed to apparatus and methods for an electronic switch, and, more particularly, to apparatus and methods for a millimeter-wave electronic rotary switch.

BACKGROUND

Switches have long been used in electrical circuit designs to isolate a portion of an electrical circuit. In its simplest form, a switch operates to allow a signal to pass from an input terminal to an output terminal in a "closed" position and to prevent the signal from passing from the input terminal to the output terminal in an "open" position. More complex switches, such as those having a single-pole dual-throw (SPDT) or a double-pole, double-throw (DPDT), switch between terminals for different functions.

In the millimeter-wave frequency range, switches may be used in instrumentation, communications, radar, fiber optic, and other systems that require high-frequency switching. For example, a switch can be used for pulse modulation, port isolation, transfer switching, high-speed switching, replacement of mechanical parts, and other switch applications.

Embodiments of the disclosed apparatus and methods address shortcomings in the prior art.

DETAILED DESCRIPTION

As described herein, embodiments are directed to an electronic switch, particularly electronic switches suited for high-frequency applications such as millimeter-wave radio frequency (RF) signals. Embodiments provide a robust switching mechanism in a hermetic package that is capable of surviving millions of cycles with little or no unwanted attenuation. Accordingly, in some embodiments all non-electrical contact surfaces that are subject to motion can be made of sapphire to provide long-wearing surfaces and to reduce the generation of particles that might contaminate the switch. To perform the switching function, in embodiments a rotator assembly disengages from the input/output paths of the switch, rotates to a new position, and then reengages the input/output paths of the switch. In embodiments, magnets cooperate to perform the switching function without the aid of any mechanical mechanism external to the electronic switch.

The disclosed electronic switch may be suitable for any high-frequency switching application, including for electronic test and measurement instruments. The term "high frequency" as used in this disclosure generally means above about 30 GHz.

Figure 1:
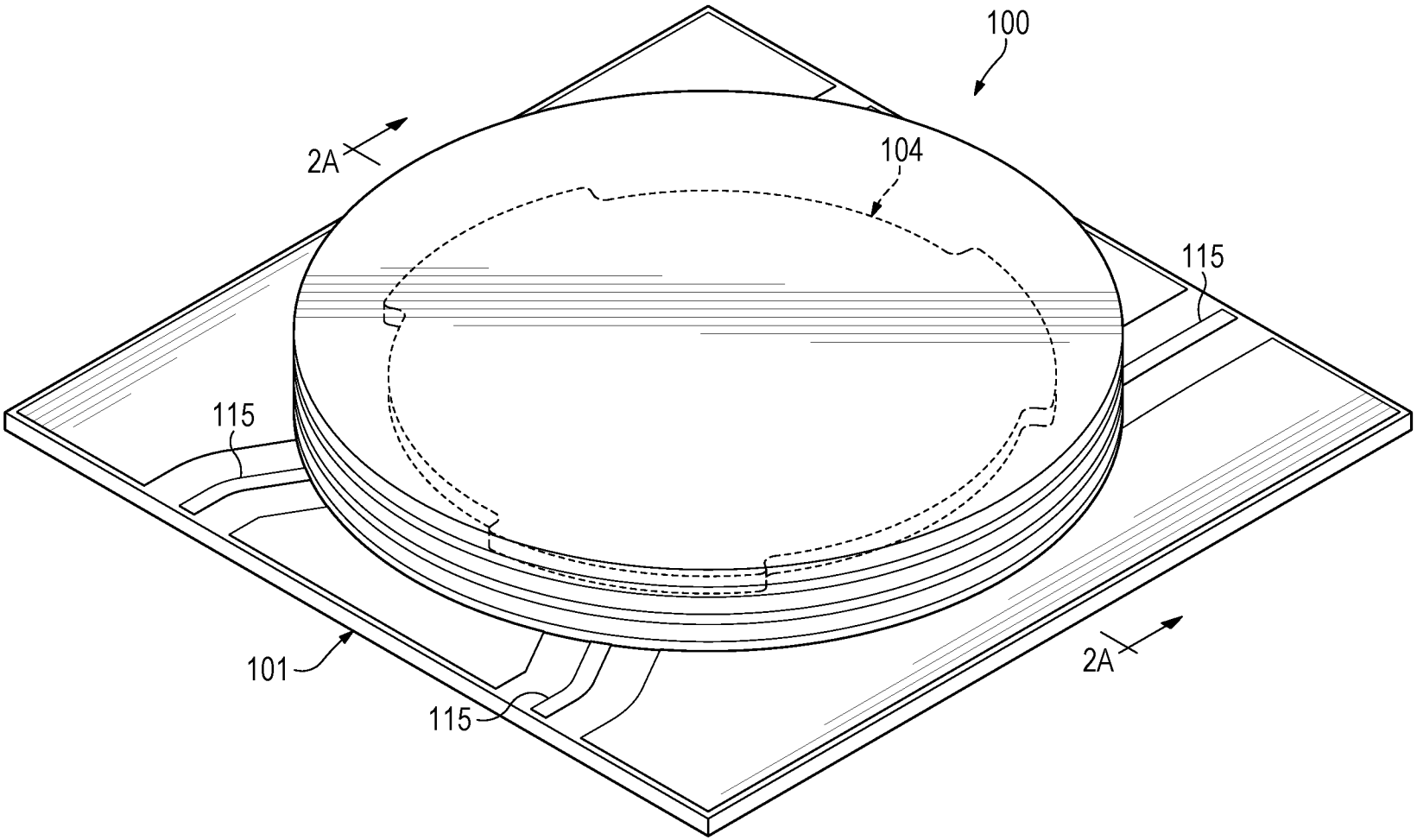
FIG. 1 is an isometric view of an electronic rotary switch, according to embodiments.
Figure 2A:
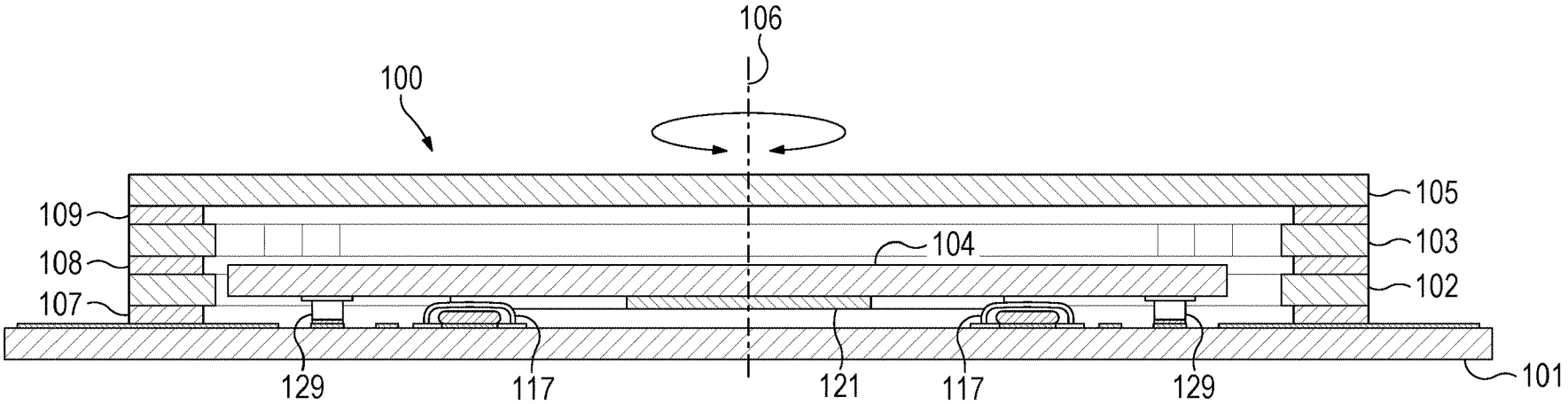
FIG. 2A is a sectional view of the electronic rotary switch of FIG. 1, showing a rotator assembly in an example first translational position.
Figure 2B:
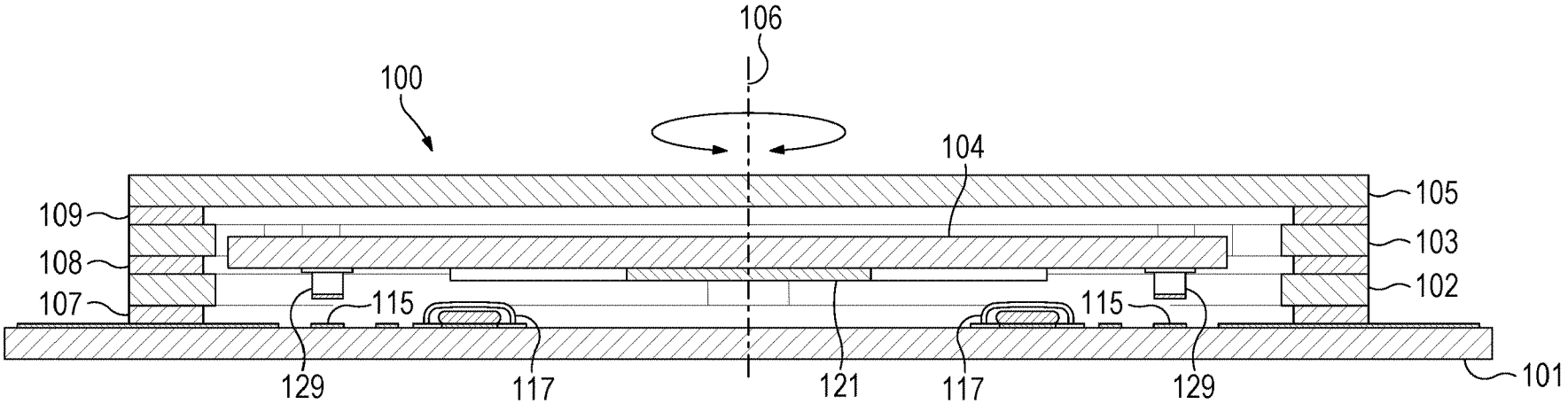
FIG. 2B is a sectional view of the electronic rotary switch of FIG. 1, showing the rotator assembly in an example second translational position.

FIG. 1 is an isometric view showing portions of an electronic rotary switch 100, according to embodiments. FIG. 2A and FIG. 2B are sectional views of the electronic rotary switch 100 of FIG. 1. As illustrated in FIGS. 2A and 2B, the electronic rotary switch 100 may include a substrate 101, a first keyed ring 102, a second keyed ring 103, a rotator assembly 104, and a lid 105. The rotator assembly 104 may include a rotational axis 106 (see also FIG. 5). FIG. 2A shows the rotator assembly 104 in an example first translational position that is closer to the substrate 101. FIG. 2B shows the rotator assembly 104 in an example second translational position that is farther from the substrate 101 than the first translational position. Stated another way, the second translational position of the rotator assembly 104 is translationally offset from the first translational position of the rotator assembly 104 along the rotational axis 106 of the rotator assembly 104 and in a direction away from the substrate 101. For example, in the first translational position, the rotator assembly 104 may be substantially aligned with the first keyed ring 102, and, in the second translational position, the rotator assembly 104 may be substantially aligned with the second keyed ring 103.

Figure 3:
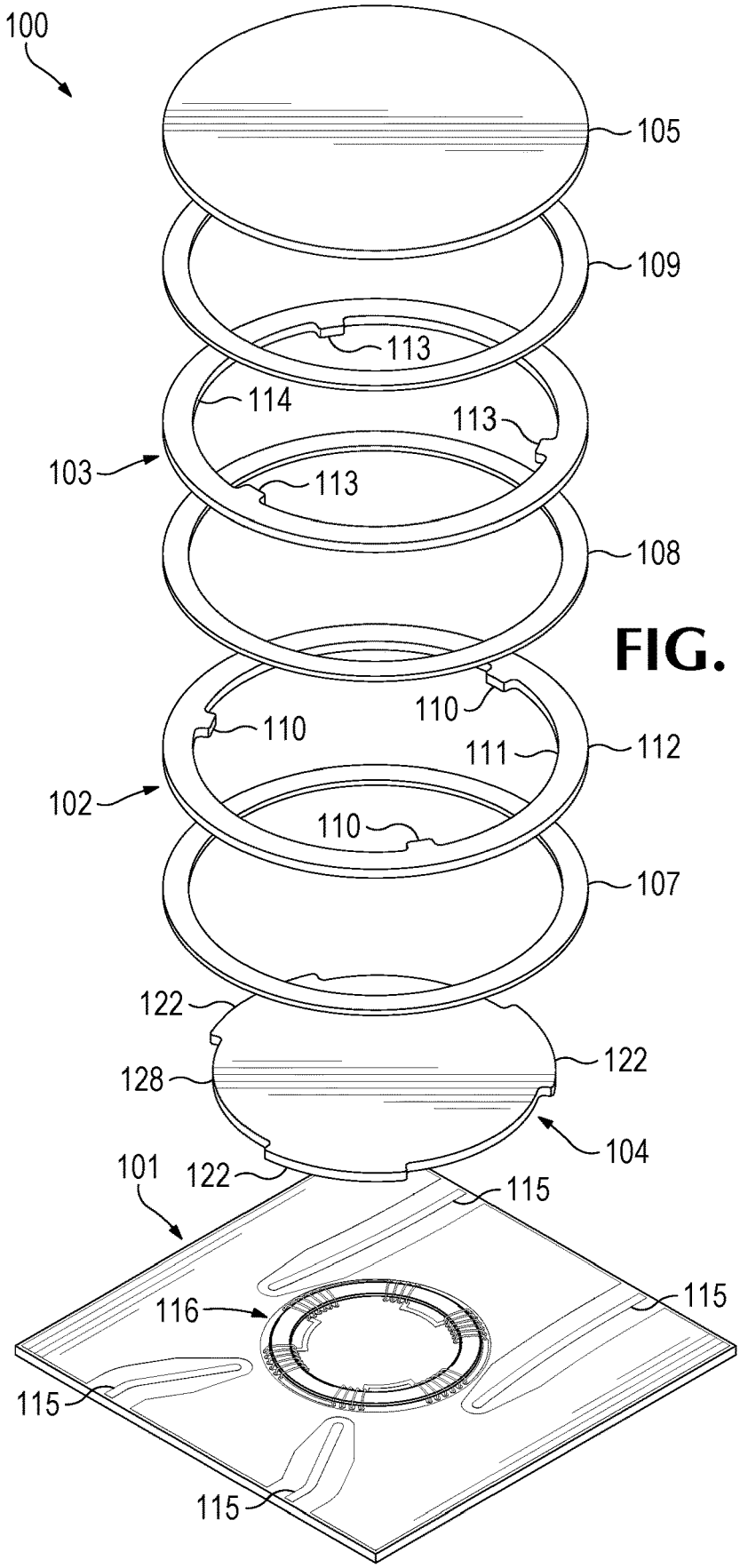
FIG. 3 is an exploded view of the electronic rotary switch of FIG. 1.

FIG. 3 is an exploded view showing portions of the electronic rotary switch 100 of FIG. 1. As illustrated in FIG. 3, the electronic rotary switch 100 may include the substrate 101, the first keyed ring 102, the second keyed ring 103, the rotator assembly 104, and the lid 105. The first keyed ring 102 may be bonded to the substrate 101 by a first glass frit 107, the first keyed ring 102 may be bonded to the second keyed ring 103 by a second glass frit 108, and the lid 105 may be bonded to the second keyed ring 103 by a third glass frit 109. The substrate 101 may include electronic input/output paths 115. While described as being bonded together via glass frits 107, 108, and 109, it will be appreciated that other bonding mechanisms could be utilized without departing from the scope of this disclosure.

The first keyed ring 102 may radially surround the rotator assembly 104 in the first translational position of the rotator assembly 104. The first keyed ring 102 may have one or more protrusions 110 extending radially from an inner diameter 111 of the first keyed ring 102. Likewise, the second keyed ring 103 may radially surround the rotator assembly 104 in the second translational position of the rotator assembly 104. The second keyed ring 103 may have one or more protrusions 113 extending radially from an inner diameter 114 of the second keyed ring 103.

The lid 105 spans the inner diameter 114 of the second keyed ring 103. In one embodiment, the lid 105 is made of sapphire. Since the rotator assembly 104 may contact the lid 105 during operation of the electronic rotary switch 100, sapphire may help reduce particle generation as the rotator assembly 104 engages the lid 105 during rotation. This is due, at least in part, to the monocrystalline structure of sapphire. It will be appreciated that other monocrystalline substances could be utilized in place of sapphire to achieve a similar effect. In addition, sapphire exhibits a very low coefficient of thermal expansion (CTE) that is similar to glass and silicon. As such, thermal changes to an electronic rotary switch, configured as described above, would generate little to no stress on the various structural elements, which could help the structure maintain a hermetic seal. It will be appreciated that other elements with a sufficiently similar CTE could be utilized in place of any or all of the above described components.

The rotator assembly 104 may be within an enclosure that is hermetically sealed to the substrate 101. For example, the lid 105, the first keyed ring 102, the second keyed ring 103, and the substrate 101 may hermetically enclose the rotator assembly 104. The hermetic seal may prevent or reduce the introduction of external contamination, such as particles, into the electronic rotary switch 100.

Figure 4:
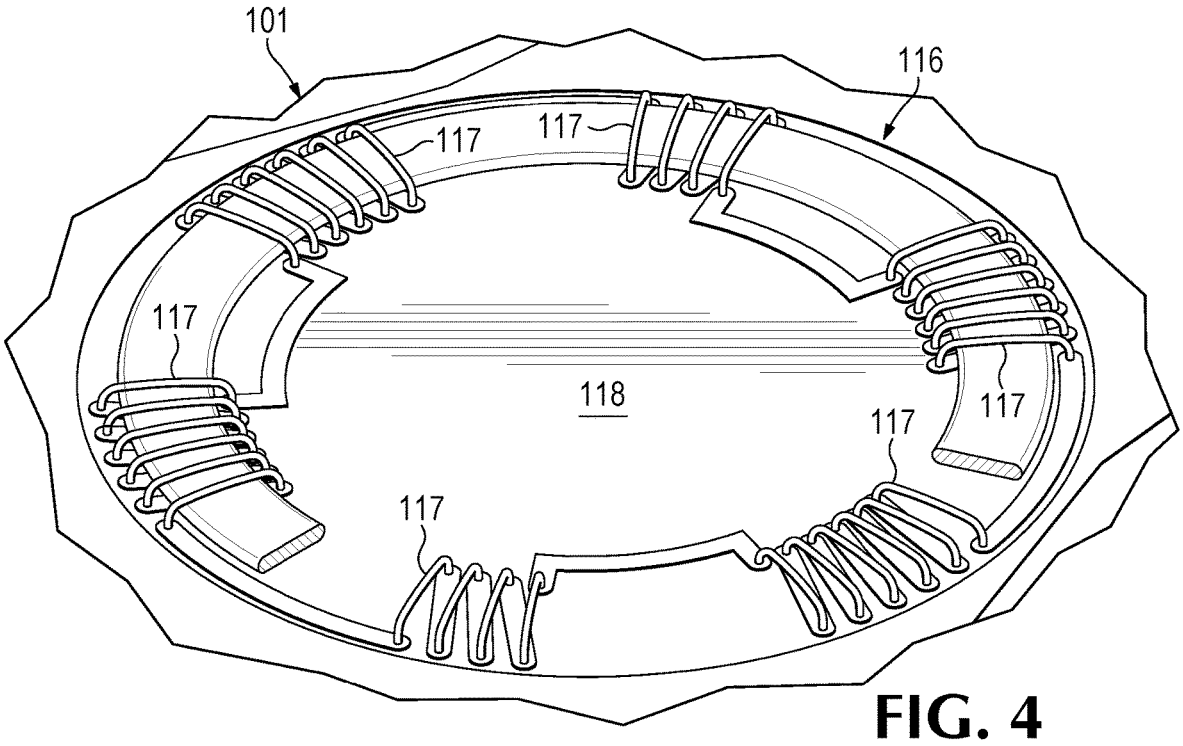
FIG. 4 is a detail view of the substrate of the electronic rotary switch of FIG. 1.

FIG. 4 is a detail view showing a portion of the substrate 101 of FIGS. 2A, 2B, and 3. As illustrated in FIG. 4, the substrate 101 may include an electromagnet 116 having electromagnet coils 117. As can be seen, portions of the electromagnet 116 are cut away in FIG. 4 so that other details may be more clearly illustrated. As illustrated in FIG. 4, a portion of the electromagnet coils 117 may be looped above a surface 118 of the substrate 101, and another portion of the electromagnet coils 117 may be traces disposed on the surface 118 of the substrate 101. The portion of the electromagnet coils 117 that are looped above the surface 118 of the substrate 101 may be formed, for example, by wire-bonding techniques, including automated wire-bonding. In other configurations, the electromagnet coils 117 could be wound around electromagnet 116 in a conventional manner. In such a configuration, there could be electrical contacts (e.g., traces) on the surface of substrate that could form an electrical connection with the electromagnet coils to enable control of the electromagnet.

In embodiments, the substrate 101 may be or may include a thin-film substrate. In such embodiments, the electronic input/output paths 115 may be, for example, gold traces with rhodium contact pads on the thin-film substrate.

Figure 5:
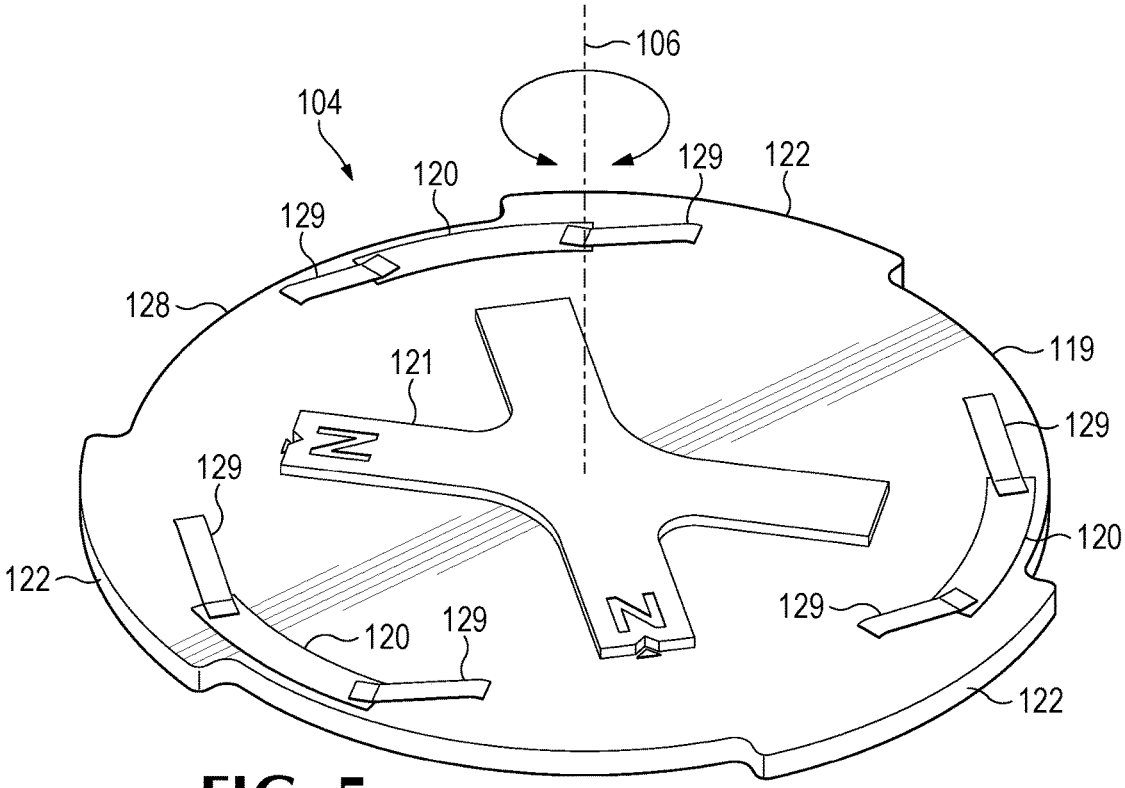
FIG. 5 is a bottom isometric view of the rotator assembly of the electronic rotary switch of FIG. 1 in isolation.

FIG. 5 is a bottom isometric view showing portions of a rotator assembly 104 of the electronic rotary switch 100 of FIG. 1. As illustrated in FIG. 5, the rotator assembly 104 may include a rotator body 119, an electrical path 120, a permanent magnet 121, and a rotational axis 106. The electrical path 120 of the rotator assembly 104 may be or may include a spring contact 129, and the spring contact 129 may be or may include a wire ribbon bonded to the rotator body 119. In embodiments, the spring contact 129 is or includes platinum. The permanent magnet 121 may interact with the electromagnet 116 (see FIG. 4) as described elsewhere in this disclosure. The rotator body 119 may be or may include a thin-film sapphire substrate.

The rotator assembly 104 may have one or more lobes 122 extending radially from an outer diameter 128 of the rotator assembly 104. The lobes 122 may interact with the protrusions 110 of the first keyed ring 102 and the protrusions 113 of the second keyed ring 103 as illustrated in FIGS. 6 and 7 and described elsewhere in this disclosure.

Hence, the electronic rotary switch 100 may include physical keying, such as the lobes 122, the protrusions 110 of the first keyed ring 102, and the protrusions 113 of the second keyed ring 103, to constrain rotation of the rotator assembly 104. In other embodiments, the physical keying may be accomplished by, for example, posts in the substrate 101 and corresponding holes in the rotator assembly 104 to receive the posts. Other mechanisms may also be used to provide the physical keying.

Figure 6:
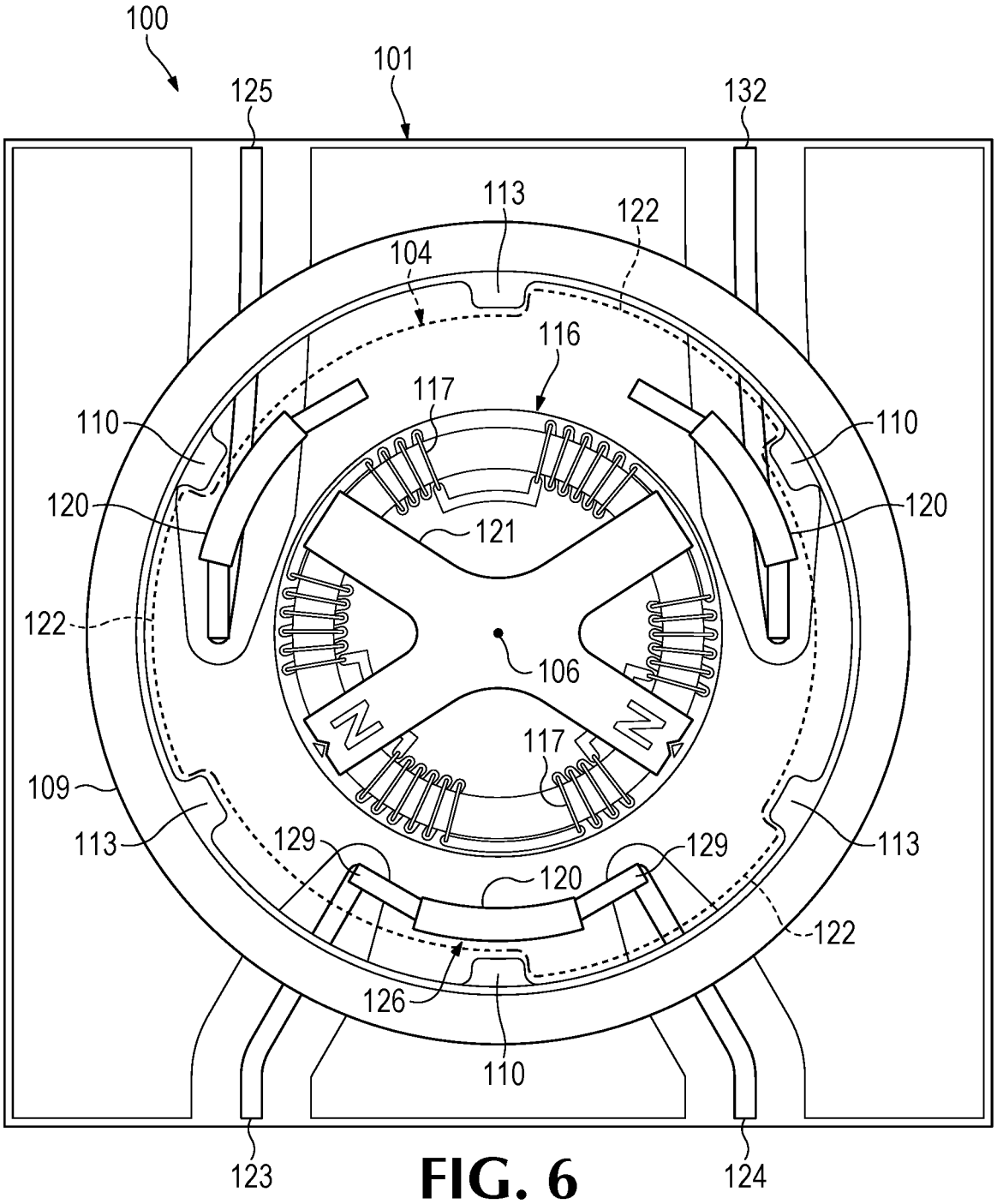
FIG. 6 is a top view of the electronic rotary switch of FIG. 1, showing the rotator assembly in an example first rotational configuration.
Figure 7:
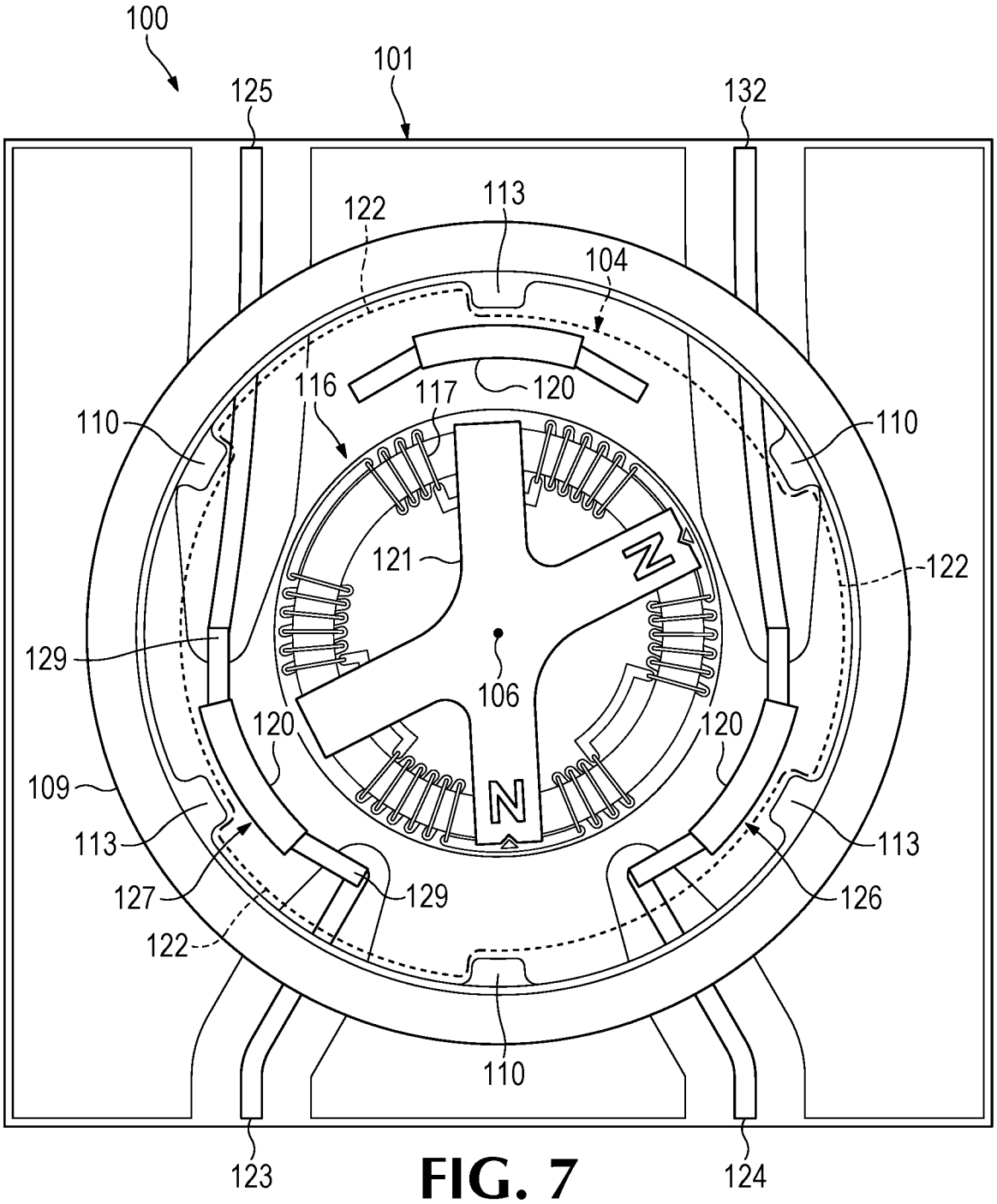
FIG. 7 is a top view of the electronic rotary switch of FIG. 1, showing the rotator assembly in an example second rotational configuration.

FIG. 6 is a top view of the electronic rotary switch 100 of FIG. 1, showing the rotator assembly 104 in an example first rotational configuration. FIG. 7 is a top view of the electronic rotary switch 100 of FIG. 1, showing the rotator assembly 104 in an example second rotational configuration. So that other features may be illustrated, FIGS. 6 and 7 do not include the lid 105, and the rotator body 119 of the rotator assembly 104 is shown in broken lines. As illustrated in FIGS. 6 and 7, the first rotational configuration of the rotator assembly 104 is rotationally offset from the second rotational configuration of the rotator assembly 104 about the rotational axis 106 of the rotator assembly 104.

The rotator assembly 104 can be configured to prevent, or limit, rotation between the first rotational configuration and the second rotational configuration in the first translational position of the rotator assembly 104. A benefit of such a configuration would be that the electrical contacts 129 of the rotator assembly 104 will not scrape against the substrate 101, and thus would limit transference of material between electrical contacts 129 and substrate 101. (See FIGS. 2A and 2B.) The rotator assembly 104 can be configured, though, to rotate between the first rotational configuration and the second rotational configuration in the second translational position of the rotator assembly 104, in which the electrical contacts 129 of the rotator assembly 104 are not in contact with substrate 101.

With further reference to FIGS. 1-9, the electronic switch may function as described here. A switching cycle may start, for example, as shown in FIG. 2A, in which the rotator assembly 104 in an example first translational position. In the first translational position, the electrical contact 129 of the rotator assembly 104 touches the substrate 101. To continue with the example, the rotator assembly 104 may also begin in the first rotational configuration, such as the first rotational configuration shown in FIG. 6. The rotator assembly 104 may be held in the first translational position and the first rotational configuration because of the interaction between the permanent magnet 121 and the electromagnet 116. For example, the electromagnet 116 may generate a magnetic field to attract the permanent magnet 121, thus clamping the rotator assembly 104 to the substrate 101.

When activated, the rotator assembly 104 may move from the first translational position to the second translational position, an example of which is shown in FIG. 2B. In the second translational position, the electrical contacts 129 of the rotator assembly 104 may not touch the substrate 101.

In the illustrated embodiment, the rotator assembly 104 moves from the first translational position to the second translational position because of the interaction between the permanent magnet 121 and the electromagnet 116. For example, the electromagnet 116 may generate a magnetic field to repel the permanent magnet 121.

During the translational motion, the physical interaction between the lobes 122 of the rotator assembly 104 with the protrusions 110 of the first keyed ring 102 and the protrusions 113 of the second keyed ring 103 constrain rotational movement of the rotator assembly 104, as illustrated in FIGS. 6 and 7. Hence, the geometries and positions of the lobes 122 and the protrusions 110, 113 can be configured to allow for little or no rotation of the rotator assembly 104 during translation of the rotator assembly 104.

In the second translational position, the rotator assembly 104 may rotate about the rotational axis 106 of the rotator assembly 104 from the first rotational position to the second rotational position, such as the second rotational configuration shown in FIG. 7. The rotator assembly 104 rotates from the first rotational position to the second rotational position because of the interaction between the permanent magnet 121 and the electromagnet 116. For example, the magnetic field of the electromagnet 116 may interact with the magnetic field of the permanent magnet 121 to produce a torque in the rotator assembly 104, causing the rotator assembly 104 to spin about its rotational axis 106. The rotational motion may stop when, for example, a lobe 122 of the rotator assembly 104 contacts a protrusion 113 of the second keyed ring 103, physically preventing further rotation in that rotational direction.

From the second rotational position, the rotator assembly 104 may move from the second translational position to the first translational position. The rotator assembly 104 may move from the second translational position to the first translational position because of the interaction between the permanent magnet 121 and the electromagnet 116. For example, the electromagnet 116 may generate a magnetic field to attract the permanent magnet 121. As above, during the translational motion, the physical interaction between the lobes 122 of the rotator assembly 104 with the protrusions 110 of the first keyed ring 102 and the protrusions 113 of the second keyed ring 103 constrain rotational movement of the rotator assembly 104.

The rotator assembly 104 may be held in the resulting first translational position and second rotational configuration because of the interaction between the permanent magnet 121 and the electromagnet 116. For example, the electromagnet 116 may generate a magnetic field to attract the permanent magnet 121, thus holding the rotator assembly 104 to the substrate 101.

To operate as an effective switch, the electrical contacts 129 of the rotator assembly 104 preferably does not contact the same input/output paths 115 in the first rotational configuration (and first translational position) and the second rotational configuration (and first translational position). Accordingly, the electrical contacts 129 may be configured to electrically connect a first electronic input/output path to a second electronic input/output path when the rotator assembly 104 is in the first rotational configuration and the first translational position. Also, the electrical contacts 129 may be configured not to electrically connect the first electronic input/output path to the second electronic input/output path in the second rotational configuration of the rotator assembly 104. Hence, as an example, the electronic input/output paths labeled 123 and 124 are connected by the electrical path labeled 126 in FIG. 6, which illustrates an example first rotational configuration. But the electronic input/output paths labeled 123 and 124 are not connected in FIG. 7, which illustrates an example second rotational configuration. Additionally, different paths may be connected in the second rotational configuration when compared to the first rotational configuration. So, as another example, the electronic input/output paths labeled 123 and 125 are connected by the electrical path labeled 127 in FIG. 7, but the electronic input/output paths labeled 123 and 125 are not connected in FIG. 6.

The above process may then be reversed, returning the rotator assembly 104 to the starting point of this example: the first translational position and first rotational configuration. The choice of a starting point, though, was simply to illustrate one cycle of movement of the rotator assembly 104.

Figure 8A:
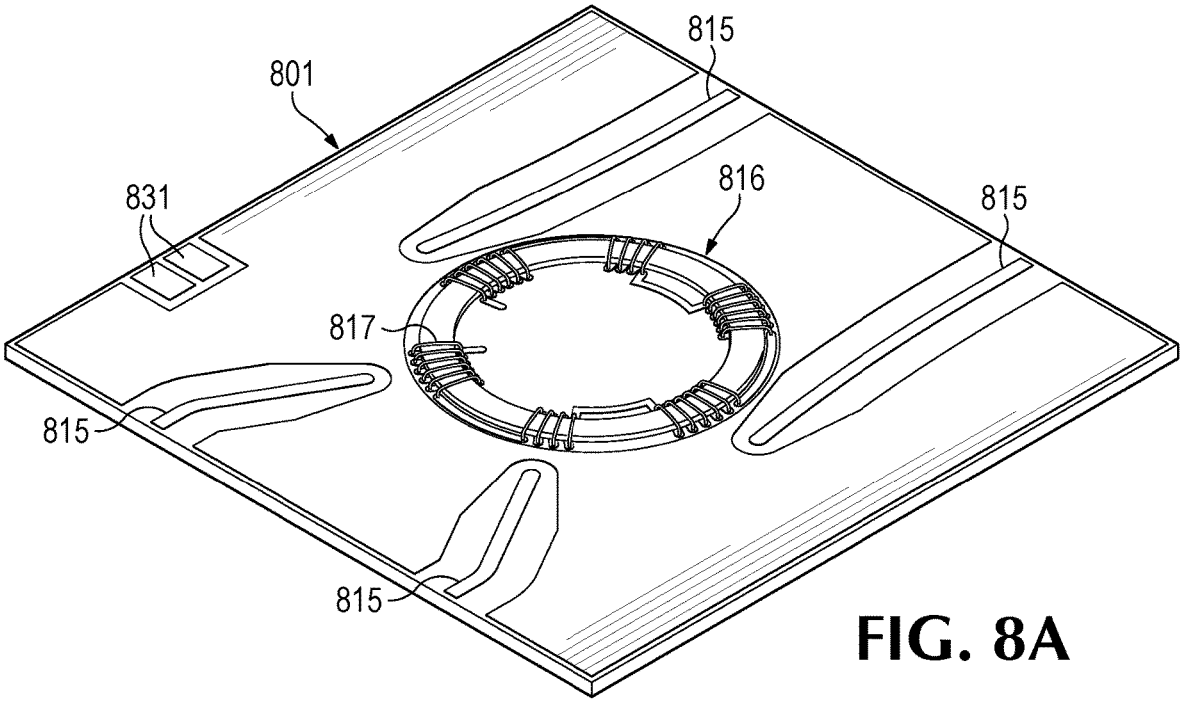
FIG. 8A is a top isometric view of a substrate with an electromagnet, according to embodiments.
Figure 8B:
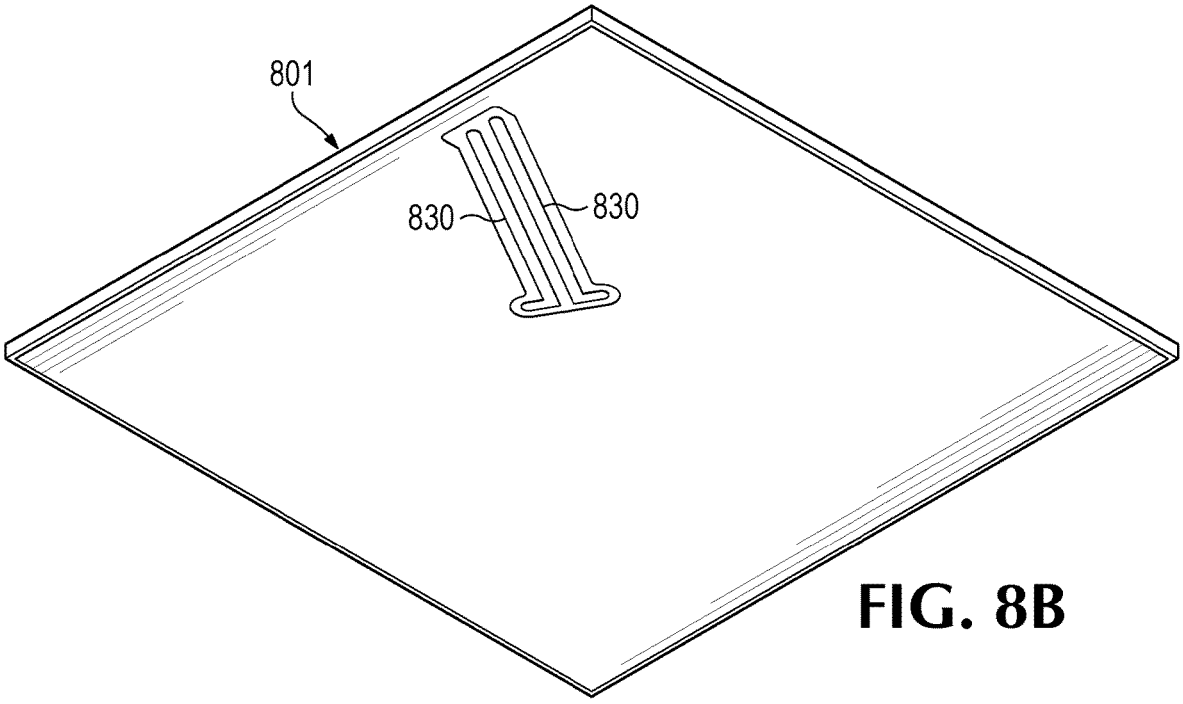
FIG. 8B is a bottom isometric view of the substrate of FIG. 8A.

FIG. 8A is a top isometric view of a substrate with an electromagnet, showing details of a potential implementation for the electromagnet 116 discussed above for FIGS. 1-7. FIG. 8B is a bottom isometric view of the substrate of FIG. 8A. As illustrated in FIGS. 8A and 8B, and in addition to what is described above for the substrate 101 of FIGS. 1-7, a substrate 801 may include electronic input/output paths 815 and an electromagnet 816 having electromagnet coils 817. The substrate 801 may further include electromagnet input/output paths 830 and electromagnet pads 831 configured to provide electrical current to the electromagnet coils 817. The electromagnet pads 831 are electrically connected to the electromagnet input/output paths 830, for example, through a via.

In embodiments, the electromagnet coils 817 may be split into two or more separate segments, each segment having its own electromagnet input/output paths and pads or sharing electromagnet input/output paths and pads with a non-adjacent segment. In such embodiments, each segment may be separately activated by applying different currents at different times to each segment. Stated another way, the electromagnet 816 may be a plurality of independently controllable electromagnets. Accordingly, the electromagnetic field generated by the electromagnet 816 may be manipulated in time and space to interact with the permanent magnet 121 and move the rotator body 119 as desired.

The electronic switch may be configured, for example, as a bypass switch, such as shown in FIGS. 1-8. For example, with particular reference to FIGS. 6 and 7, the electronic input/output path labeled 123 may be the input and the electronic input/output path labeled 124 may be the output. Also, an external circuit element may connect the electronic input/output paths labeled 125 and 132 externally to the electronic rotary switch 100. In this example, FIG. 6 shows the electronic rotary switch 100 in bypass mode, where an external circuit element would be bypassed because the input path 123 is connected directly to the output path 124 through the electrical path labeled 126. Accordingly, as illustrated in FIG. 6, in bypass mode a signal passes through only one switch element, the electrical path labeled 126. Continuing this same example, an external circuit element that connects the electronic input/output paths labeled 125 and 132 would not be bypassed in the configuration of FIG. 7. As illustrated in FIG. 7, a signal input at the input path 123 would pass to the input/output path labeled 125 through the switch element labeled 127. Likewise, a signal at the input/output path labeled 132 would pass to the output path 124 through the switch element labeled 126.

Figure 9:
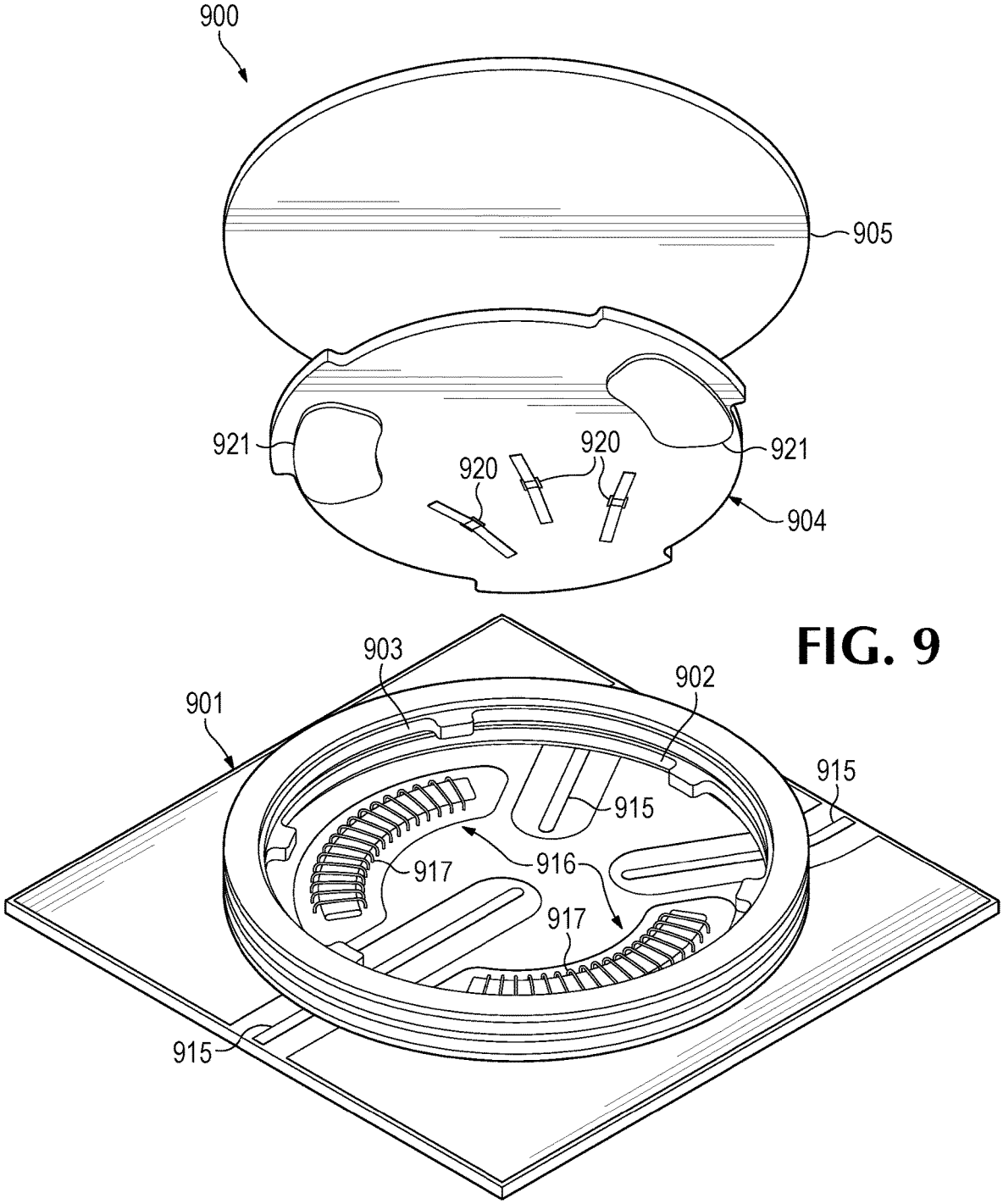
FIG. 9 is an exploded view of an electronic rotary switch, according to embodiments.

As another example, the electronic switch may be configured as a single-pole, double-throw (SPDT) switch, an example of which is shown in FIG. 9. Other topologies may also be used, including a double-pole, double-throw (DPDT) topology.

As illustrated in FIG. 9, an electronic rotary switch 900 may include a substrate 901, a first keyed ring 902, a second keyed ring 903, a rotator assembly 904, and a lid 905. Each of these components are generally as described above for the electronic rotary switch 100 of FIGS. 1-8, except as noted here. Specifically, for switching topologies other than the bypass switch of FIGS. 1-8, the configuration and location of the permanent magnet 921, electronic input/output paths 915, electromagnet 916 with electromagnet coils 917, and electrical contact 920 may differ from what is shown in FIGS. 1-8.

Accordingly, embodiments of the disclosed technology provide an electronic switch particularly suited for high-frequency applications. The electronic switch may be relatively small. For example, in embodiments the first keyed ring 102 may have an outer diameter 112 not exceeding about five millimeters, although other sizes may also be suitable depending upon the intended application.

Figure 10:
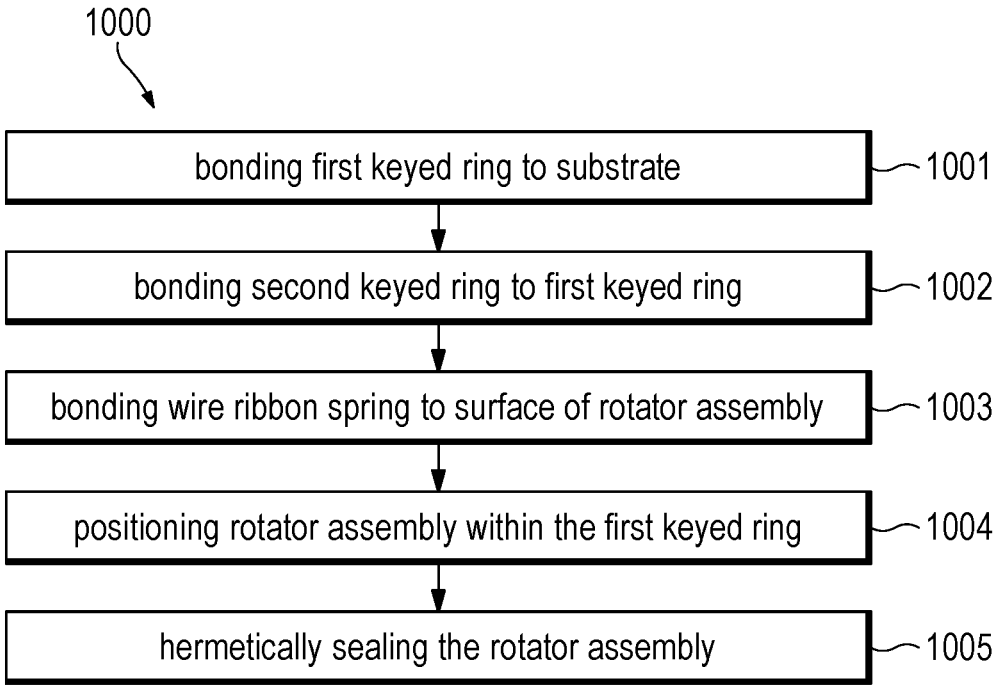
FIG. 10 shows an example method for assembling an electronic switch, according to embodiments.

FIG. 10 shows an example method for assembling an electronic switch, according to embodiments. As illustrated in FIG. 10, a method 1000 for assembling an electronic switch may include bonding 1001 a first keyed ring to a substrate, the substrate having an electronic input path and an electronic output path, the first keyed ring having one or more protrusions extending radially from an inner diameter of the first keyed ring; bonding 1002 a second keyed ring to the first keyed ring, the second keyed ring having one or more protrusions extending radially from an inner diameter of the second keyed ring; and positioning 1004 a rotator assembly within an inner diameter of the first keyed ring, the rotator assembly having a rotational axis and an electrical contact configured to electrically connect the electronic input path to the electronic output path in a first rotational configuration of the rotator assembly and to disconnect the electronic input path from the electronic output path in a second rotational configuration of the rotator assembly, the first rotational configuration of the rotator assembly being rotationally offset from the second rotational configuration of the rotator assembly about the rotational axis.

The method of FIG. 10 may optionally include hermetically sealing 1005 the rotator assembly within the first keyed ring and the second keyed ring by bonding a lid to the second keyed ring, the lid spanning the inner diameter of the second keyed ring.

The method of FIG. 10 may optionally include bonding 1003 a wire ribbon spring to a surface of the rotator assembly.

Figure 11:
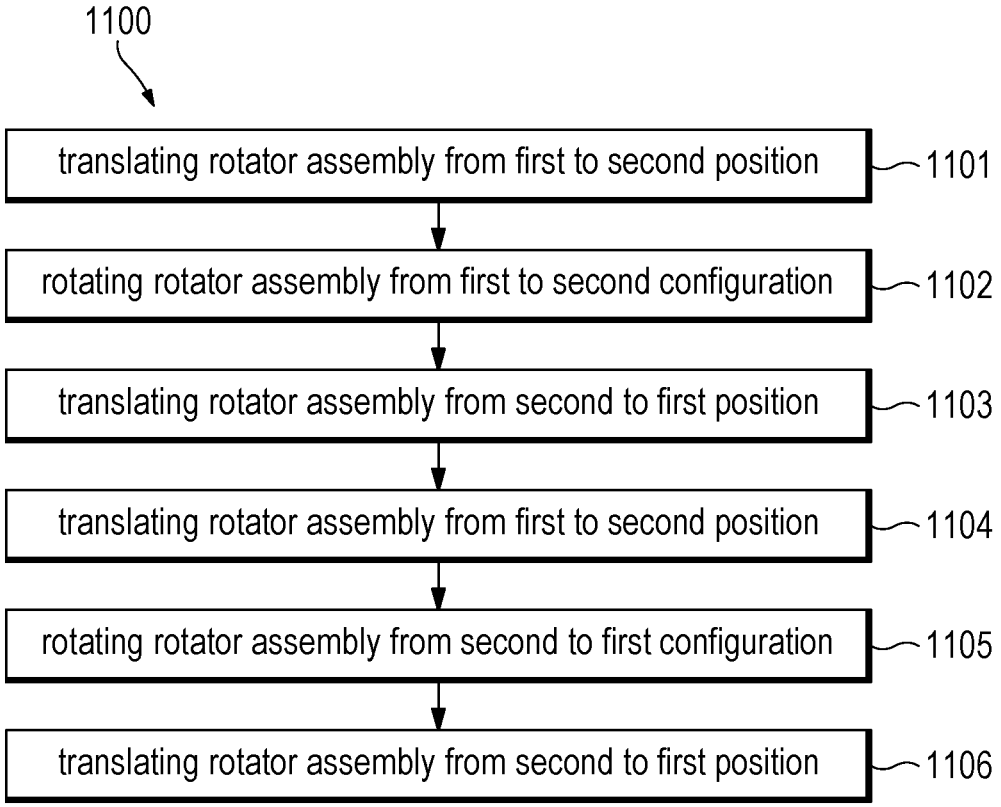
FIG. 11 shows an example method for operating an electronic switch, according to embodiments.

FIG. 11 shows an example method for operating an electronic switch, according to embodiments. As illustrated in FIG. 11, a method 1100 for operating an electronic switch may include, in sequence, translating 1101 a rotator assembly from a first translational position of the rotator assembly to a second translational position of the rotator assembly, the second translational position of the rotator assembly being offset from the first translational position of the rotator assembly along a rotational axis of the rotator assembly in a direction away from a substrate, the substrate having an electronic input path and an electronic output path, the rotator assembly having an electrical contact, the electrical contact being configured not to electrically connect the electronic input path to the electronic output path in the second translational position of the rotator assembly; rotating 1102 the rotator assembly from a first rotational configuration to a second rotational configuration, the first rotational configuration of the rotator assembly being rotationally offset from the second rotational configuration of the rotator assembly about the rotational axis, the electrical contact being configured not to electrically connect the electronic input path to the electronic output path in the second rotational configuration of the rotator assembly; and translating 1103 the rotator assembly from the second translational position of the rotator assembly to the first translational position of the rotator assembly.

The method of FIG. 11 may also include, in sequence, translating 1104 the rotator assembly from the first translational position of the rotator assembly to the second translational position of the rotator assembly; rotating 1105 the rotator assembly from the second rotational configuration to the first rotational configuration; and translating 1106 the rotator assembly from the second translational position of the rotator assembly to the first translational position of the rotator assembly, the electrical contact being configured to electrically connect the electronic input path to the electronic output path when the rotator assembly is in both the first rotational configuration and the first translational position of the rotator assembly.

EXAMPLES

Illustrative examples of the disclosed technologies are provided below. An embodiment of the technologies may include one or more, and any combination of, the examples described below.

Example 1 includes an electronic switch comprising: a substrate having an electronic input path and an electronic output path; and a rotator assembly having a rotational axis and an electrical contact, a first rotational configuration of the rotator assembly being rotationally offset from a second rotational configuration of the rotator assembly about the rotational axis, the rotator assembly being configured not to rotate between the first rotational configuration and the second rotational configuration in a first translational position of the rotator assembly, the rotator assembly being configured to rotate between the first rotational configuration and the second rotational configuration in a second translational position of the rotator assembly, the second translational position of the rotator assembly being translationally offset from the first translational position of the rotator assembly along the rotational axis in a direction away from the substrate, and the electrical contact being configured to electrically connect the electronic input path to the electronic output path in the first rotational configuration and first translational position of the rotator assembly, the electrical contact being configured not to electrically connect the electronic input path to the electronic output path in the second rotational configuration of the rotator assembly, and the electrical contact being configured not to electrically connect the electronic input path to the electronic output path in the second translational position of the rotator assembly.

Example 2 includes the electronic switch of Example 1, further comprising an electromagnet and a permanent magnet, in which the electromagnet and the permanent magnet are, in combination, configured to translate the rotator assembly along the rotational axis in the direction away from the substrate and in a direction toward the substrate, and in which the electromagnet and the permanent magnet are in combination configured to rotate the rotator assembly between the first rotational configuration and the second rotational configuration of the rotator assembly.

Example 3 includes the electronic switch of Example 1, in which the rotator assembly includes a permanent magnet and in which the substrate includes an electromagnet, in which the electromagnet and the permanent magnet are, in combination, configured to translate the rotator assembly along the rotational axis in the direction away from the substrate and in a direction toward the substrate, and in which the electromagnet and the permanent magnet are, in combination, configured to rotate the rotator assembly between the first rotational configuration and the second rotational configuration of the rotator assembly.

Example 4 includes the electronic switch of any of Examples 2-3, in which the electromagnet comprises electromagnet coils, a portion of the electromagnet coils being looped above a surface of the substrate.

Example 5 includes the electronic switch of any of Examples 2-4, in which the electromagnet comprises a plurality of independently controllable electromagnets.

Example 6 includes the electronic switch of any of Examples 1-5, in which the rotator assembly is within an enclosure hermetically sealed to the substrate.

Example 7 includes the electronic switch of any of Examples 1-6, further comprising physical keying configured to constrain rotation of the rotator assembly.

Example 8 includes the electronic switch of any of Examples 1-6, further comprising a first keyed ring radially surrounding the rotator assembly in the first translational position of the rotator assembly, the first keyed ring having one or more protrusions extending radially from an inner diameter of the first keyed ring and configured to constrain rotation of the rotator assembly.

Example 9 includes the electronic switch of Example 8, in which the first keyed ring comprises sapphire.

Example 10 includes the electronic switch of any of Examples 8-9, further comprising a second keyed ring radially surrounding the rotator assembly in the second translational position of the rotator assembly, the second keyed ring having one or more protrusions extending radially from an inner diameter of the second keyed ring and configured to constrain rotation of the rotator assembly between the first rotational configuration and the second rotational configuration of the rotator assembly.

Example 11 includes the electronic switch of Example 10, in which the second keyed ring comprises sapphire.

Example 12 includes the electronic switch of any of Examples 10-11, in which the rotator assembly has one or more lobes extending radially from an outer diameter of the rotator assembly, the one or more lobes configured to abut at least one of the one or more protrusions of the first keyed ring in the first translational position of the rotator assembly, the one or more lobes further configured to abut at least one of the one or more protrusions of the second keyed ring in the second translational position of the rotator assembly.

Example 13 includes the electronic switch of any of Examples 10-12, further comprising a lid spanning the inner diameter of the second keyed ring.

Example 14 includes the electronic switch of Example 13, in which the first keyed ring is bonded to the substrate by a first glass frit, in which the first keyed ring is bonded to the second keyed ring by a second glass frit, and in which the lid is bonded to the second keyed ring by a third glass frit.

Example 15 includes the electronic switch of any of Examples 13-14, in which the lid, the first keyed ring, the second keyed ring, and the substrate hermetically enclose the rotator assembly.

Example 16 includes the electronic switch of any of Examples 1-15, in which the rotator assembly comprises a thin-film sapphire substrate.

Example 17 includes the electronic switch of any of Examples 1-16, in which the electrical contact of the rotator assembly comprises a spring contact.

Example 18 includes the electronic switch of Example 17, in which the spring contact comprises a wire ribbon bonded to a surface of the rotator assembly.

Example 19 includes the electronic switch of any of Examples 17-18, in which the spring contact comprises platinum.

Example 20 includes the electronic switch of any of Examples 1-19, in which the substrate comprises a thin-film substrate.

Example 21 includes the electronic switch of Example 20, in which the electronic input path and the electronic output path are gold traces with rhodium contact pads on the thin-film substrate.

Example 22 includes the electronic switch of any of Examples 1-21, in which the electronic switch is configured as a bypass switch.

Example 23 includes the electronic switch of any of Examples 1-21, in which the electronic switch is configured as a single-pole, double-throw (SPDT) switch.

Example 24 includes the electronic switch of any of Examples 1-21, in which the electronic switch is configured as a double-pole, double-throw (DPDT) switch.

Example 25 includes a method of assembling an electronic switch, the method comprising: bonding a first keyed ring to a substrate, the substrate having an electronic input path and an electronic output path, the first keyed ring having one or more protrusions extending radially from an inner diameter of the first keyed ring; bonding a second keyed ring to the first keyed ring, the second keyed ring having one or more protrusions extending radially from an inner diameter of the second keyed ring; and positioning a rotator assembly within an inner diameter of the first keyed ring, the rotator assembly having a rotational axis and an electrical contact configured to electrically connect the electronic input path to the electronic output path in a first rotational configuration of the rotator assembly and to disconnect the electronic input path from the electronic output path in a second rotational configuration of the rotator assembly, the first rotational configuration of the rotator assembly being rotationally offset from the second rotational configuration of the rotator assembly about the rotational axis.

Example 26 includes the method of Example 25, further comprising hermetically sealing the rotator assembly within the first keyed ring and the second keyed ring by bonding a lid to the second keyed ring, the lid spanning the inner diameter of the second keyed ring.

Example 27 includes the method of Example 26, in which bonding the first keyed ring to the substrate comprises bonding the first keyed ring to the substrate by a first glass frit, in which bonding the second keyed ring to the first keyed ring comprises bonding the second keyed ring to the first keyed ring by a second glass frit, and in which bonding the lid to the second keyed ring comprises bonding the lid to the second keyed ring by a third glass frit.

Example 28 includes the method of any of Examples 25-27, in which the electrical contact of the rotator assembly comprises a wire ribbon spring, the method further comprising bonding the wire ribbon spring to a surface of the rotator assembly.

Example 29 includes a method of operating an electronic switch, the method comprising, in sequence: translating a rotator assembly from a first translational position of the rotator assembly to a second translational position of the rotator assembly, the second translational position of the rotator assembly being offset from the first translational position of the rotator assembly along a rotational axis of the rotator assembly in a direction away from a substrate, the substrate having an electronic input path and an electronic output path, the rotator assembly having an electrical contact, the electrical contact being configured not to electrically connect the electronic input path to the electronic output path in the second translational position of the rotator assembly; rotating the rotator assembly from a first rotational configuration to a second rotational configuration, the first rotational configuration of the rotator assembly being rotationally offset from the second rotational configuration of the rotator assembly about the rotational axis, the electrical contact being configured not to electrically connect the electronic input path to the electronic output path in the second rotational configuration of the rotator assembly; and translating the rotator assembly from the second translational position of the rotator assembly to the first translational position of the rotator assembly.

Example 30 includes the method of Example 29, further comprising, in sequence: translating the rotator assembly from the first translational position of the rotator assembly to the second translational position of the rotator assembly; rotating the rotator assembly from the second rotational configuration to the first rotational configuration; and translating the rotator assembly from the second translational position of the rotator assembly to the first translational position of the rotator assembly, the electrical contact being configured to electrically connect the electronic input path to the electronic output path when the rotator assembly is in both the first rotational configuration and the first translational position of the rotator assembly.

Example 31 includes the method of any of Examples 29-30, in which the electronic switch further comprises a permanent magnet and an electromagnet, in which translating the rotator assembly from a first translational position of the rotator assembly to a second translational position of the rotator assembly, rotating the rotator assembly from the first rotational configuration to the second rotational configuration, and translating the rotator assembly from the second translational position of the rotator assembly to the first translational position of the rotator assembly are each by interaction of a magnetic field of the permanent magnet with a magnetic field of the electromagnet.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments have been illustrated and described for purposes of illustration, it will be understood that various modifications may be made without departing from the spirit and scope of the disclosure. Accordingly, the invention should not be limited except as by the appended claims.

The invention claimed is:

1. An electronic switch comprising:

a substrate having an electronic input path and an electronic output path; and a rotator assembly having a rotational axis and an electrical contact, a first rotational configuration of the rotator assembly being rotationally offset from a second rotational configuration of the rotator assembly about the rotational axis, the rotator assembly being configured to prevent rotation between the first rotational configuration and the second rotational configuration in a first translational position of the rotator assembly, the rotator assembly being configured to rotate between the first rotational configuration and the second rotational configuration in a second translational position of the rotator assembly, the second translational position of the rotator assembly being translationally offset from the first translational position of the rotator assembly along the rotational axis in a direction away from the substrate, and the electrical contact being configured to electrically connect the electronic input path to the electronic output path in the first rotational configuration and first translational position of the rotator assembly, the electrical contact being configured not to electrically connect the electronic input path to the electronic output path in the second rotational configuration of the rotator assembly, and the electrical contact being configured not to electrically connect the electronic input path to the electronic output path in the second translational position of the rotator assembly.

2. The electronic switch of claim 1, further comprising an electromagnet and a permanent magnet, in which the electromagnet and the permanent magnet are, in combination, configured to translate the rotator assembly along the rotational axis in the direction away from the substrate and in a direction toward the substrate, and in which the electromagnet and the permanent magnet are in combination configured to rotate the rotator assembly between the first rotational configuration and the second rotational configuration of the rotator assembly.

3. The electronic switch of claim 2, in which the electromagnet comprises electromagnet coils, a portion of the electromagnet coils being looped above a surface of the substrate.

4. The electronic switch of claim 2, in which the electromagnet comprises a plurality of independently controllable electromagnets.

5. The electronic switch of claim 1, in which the rotator assembly is within an enclosure hermetically sealed to the substrate.

6. The electronic switch of claim 1, further comprising physical keying configured to constrain rotation of the rotator assembly.

7. The electronic switch of claim 1, further comprising a first keyed ring radially surrounding the rotator assembly in the first translational position of the rotator assembly, the first keyed ring having one or more protrusions extending radially from an inner diameter of the first keyed ring and configured to constrain rotation of the rotator assembly.

8. The electronic switch of claim 7, further comprising a second keyed ring radially surrounding the rotator assembly in the second translational position of the rotator assembly, the second keyed ring having one or more protrusions extending radially from an inner diameter of the second keyed ring and configured to constrain rotation of the rotator assembly between the first rotational configuration and the second rotational configuration of the rotator assembly.

9. The electronic switch of claim 8, in which the first keyed ring and the second keyed ring comprise sapphire.

10. The electronic switch of claim 8, in which the rotator assembly has one or more lobes extending radially from an outer diameter of the rotator assembly, the one or more lobes configured to abut at least one of the one or more protrusions of the first keyed ring in the first translational position of the rotator assembly, the one or more lobes further configured to abut at least one of the one or more protrusions of the second keyed ring in the second translational position of the rotator assembly.

11. The electronic switch of claim 8, further comprising a lid spanning the inner diameter of the second keyed ring.

12. The electronic switch of claim 11, in which the first keyed ring is bonded to the substrate by a first glass frit, in which the first keyed ring is bonded to the second keyed ring by a second glass frit, and in which the lid is bonded to the second keyed ring by a third glass frit.

13. The electronic switch of claim 11, in which the lid, the first keyed ring, the second keyed ring, and the substrate hermetically enclose the rotator assembly.

14. The electronic switch of claim 1, in which the rotator assembly comprises a thin-film sapphire substrate.

15. The electronic switch of claim 1, in which the electrical contact of the rotator assembly comprises a spring contact.

16. The electronic switch of claim 15, in which the spring contact comprises a wire ribbon bonded to a surface of the rotator assembly.

17. The electronic switch of claim 16, in which the spring contact comprises platinum.

18. The electronic switch of claim 1, in which the substrate comprises a thin-film substrate.

19. The electronic switch of claim 18, in which the electronic input path and the electronic output path are gold traces with rhodium contact pads on the thin-film substrate.

20. The electronic switch of claim 1, in which the electronic switch is configured as a single-pole, double-throw (SPDT) switch.

21. The electronic switch of claim 1, in which the electronic switch is configured as a bypass switch.

22. A method of assembling an electronic switch, the method comprising:

bonding a first keyed ring to a substrate, the substrate having an electronic input path and an electronic output path, the first keyed ring having one or more protrusions extending radially from an inner diameter of the first keyed ring;

bonding a second keyed ring to the first keyed ring, the second keyed ring having one or more protrusions extending radially from an inner diameter of the second keyed ring; and positioning a rotator assembly within an inner diameter of the first keyed ring, the rotator assembly having a rotational axis and an electrical contact configured to electrically connect the electronic input path to the electronic output path in a first rotational configuration of the rotator assembly and to disconnect the electronic input path from the electronic output path in a second rotational configuration of the rotator assembly, the first rotational configuration of the rotator assembly being rotationally offset from the second rotational configuration of the rotator assembly about the rotational axis.

23. The method of claim 22, further comprising hermetically sealing the rotator assembly within the first keyed ring and the second keyed ring by bonding a lid to the second keyed ring, the lid spanning the inner diameter of the second keyed ring.

24. The method of claim 23, in which bonding the first keyed ring to the substrate comprises bonding the first keyed ring to the substrate by a first glass frit, in which bonding the second keyed ring to the first keyed ring comprises bonding the second keyed ring to the first keyed ring by a second glass frit, and in which bonding the lid to the second keyed ring comprises bonding the lid to the second keyed ring by a third glass frit.

25. The method of claim 22, in which the electrical contact of the rotator assembly comprises a wire ribbon spring, the method further comprising bonding the wire ribbon spring to a surface of the rotator assembly.

* * * * *